US006932752B2

(12) United States Patent
Garthaffner et al.

(10) Patent No.: US 6,932,752 B2
(45) Date of Patent: Aug. 23, 2005

(54) MULTIPLE GARNITURE BELT DRIVE SYSTEM FOR FILTER ROD MACHINERY

(75) Inventors: Martin T. Garthaffner, Chesterfield, VA (US); Steve R. Rinehart, Chesterfield, VA (US); G. Robert Scott, Midlothian, VA (US); Barry S. Smith, Hopewell, VA (US); Steven F. Spiers, Richmond, VA (US); Jeremy J. Straight, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 2 days.

(21) Appl. No.: 10/459,651

(22) Filed: Jun. 11, 2003

(65) Prior Publication Data

US 2004/0005975 A1 Jan. 8, 2004

Related U.S. Application Data

(60) Provisional application No. 60/393,196, filed on Jul. 1, 2002.

(51) Int. Cl.[7] ..... B31C 13/00

(52) U.S. Cl. ..... 493/39; 493/45

(58) Field of Search ..... 493/39, 45, 46, 493/47, 50

(56) References Cited

U.S. PATENT DOCUMENTS

| | | | | | |
|---|---|---|---|---|---|
| 3,795,995 | A | * | 3/1974 | Johnson | 38/2 |
| 4,103,596 | A | * | 8/1978 | Molins | 493/39 |
| 4,208,956 | A | * | 6/1980 | Hall | 493/46 |
| 4,411,640 | A | * | 10/1983 | Hall | 493/45 |
| 4,721,119 | A | * | 1/1988 | Ludszeweit et al. | 131/69 |
| 5,060,664 | A | * | 10/1991 | Siems et al. | 131/84.1 |
| 5,425,693 | A | * | 6/1995 | Gardner et al. | 493/301 |
| 6,371,901 | B1 | * | 4/2002 | Jackson et al. | 493/405 |

* cited by examiner

*Primary Examiner*—Eugene Kim
(74) *Attorney, Agent, or Firm*—Connolly Bove Lodge & Hutz LLP

(57) ABSTRACT

A machine for producing an endless filter rod comprises a multi-section garniture and a multiple garniture belt drive system that includes several garniture belts having linear aligned portions for delivering filter paper with filter components thereon through the sections of the garniture. Multiple garniture belts eliminate the need for a long belt and the disadvantages associated with a long belt such as excessive stretching and side movements or wander of the belt.

8 Claims, 3 Drawing Sheets

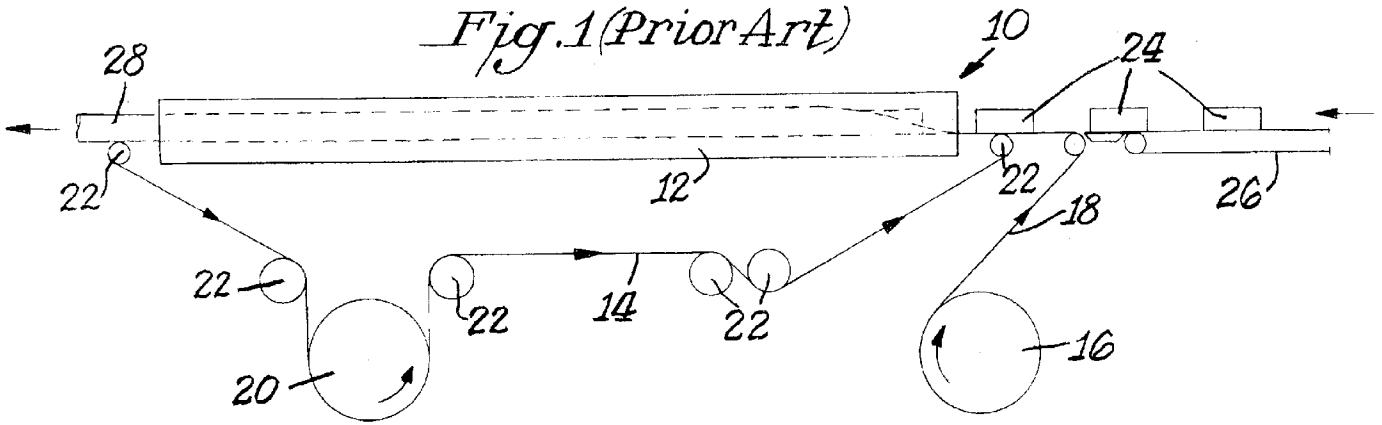
Fig. 1 (Prior Art)
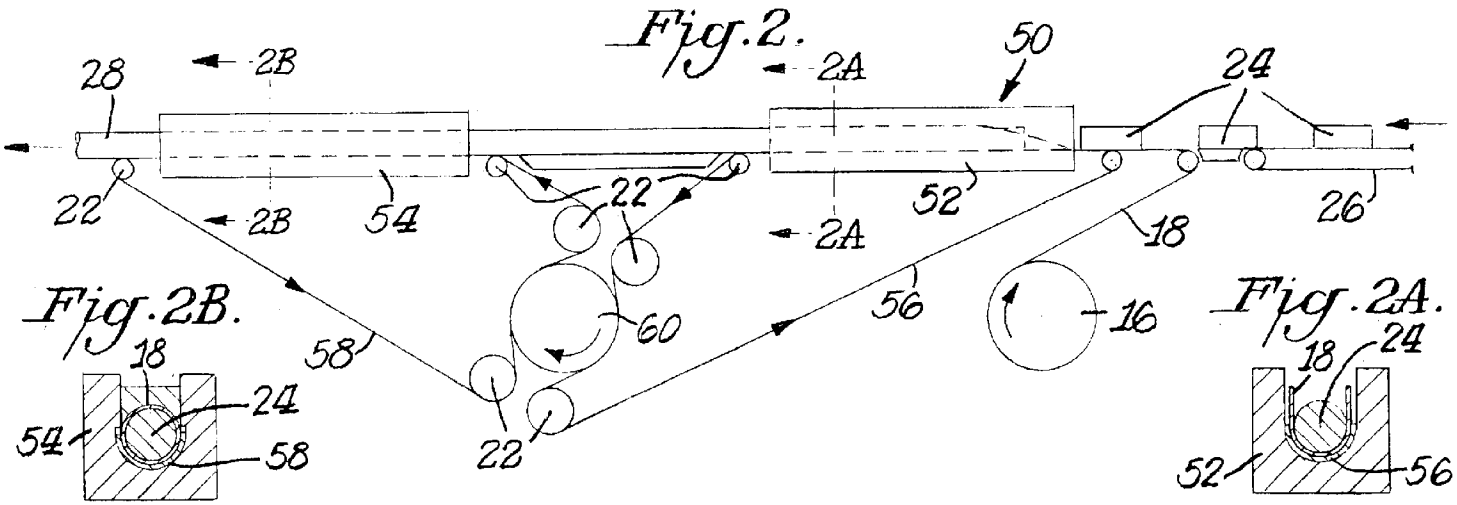
Fig. 2.
Fig. 2A.
Fig. 2B.

MULTIPLE GARNITURE BELT DRIVE SYSTEM FOR FILTER ROD MACHINERY

BACKGROUND OF THE INVENTION

The present invention relates to a machine for producing an endless filter rod, and more particularly to filter rod combining and making machinery that includes a multi-section garniture and multiple garniture belts for delivering filter paper with filter components thereon through the garniture sections along a linear path.

Filter rods for making individual cigarette filters are produced by pulling paper axially down a fluted rail or garniture. As the paper is pulled through the garniture a series of folders, adhesive application systems, and heaters and/or cooling systems form the paper around the filter components and seal the paper to produce the finished filter rod. Ultimately the cigarette filter rods are cut at selected locations along their length to form individual cigarette filters, and such individual filters are attached to tobacco rods by tipping paper, as is well known in the art. Paper is pulled through the garniture by a single endless garniture belt which is driven by a rotating drum. As the paper enters the garniture, filter material such as cellulose acetate tow and/or other components such as carbon granules are deposited on the paper.

The garniture belt is driven by the machine in such a way that the paper speed matches the delivery of the filter material and/or other components. Various paper forming operations, insertion stations to add additional filtering materials, filter rod inspection, and the like occur during the rod forming process in the garniture. These operations result in the need to increase the length of the machine and separate the garniture into multiple sections. This increase in machine length and separation of the garniture into spaced apart sections increases the length of the garniture belt. Garniture belts are currently available in lengths up to 7 meters. However, these longer belts are difficult to run due to excessive stretch and side movement or wander of the belt.

SUMMARY OF THE INVENTION

Accordingly, one of the objects of the present invention is the provision of multiple garniture belts to avoid the use of a single excessively long belt which is difficult to operate because of excessive strength and side movements.

Another object of the present invention is a belt drive system that automatically controls the speed of multiple garniture belts on filter rod combining and making machinery.

In accordance with the present invention, a machine for producing an endless filter rod comprises a garniture and multiple garniture belts having linear aligned portions for delivering filter paper with filter components thereon through the garniture along a linear path.

The garniture may include upstream and downstream garniture sections in alignment and spaced apart from one another, and the multiple garniture belts may comprise an upstream belt passing through the upstream garniture section and a downstream garniture belt passing through the downstream garniture section.

In one embodiment of the present invention a single motor driven drum is connected to frictionally engage both the upstream and downstream garniture belts for driving the belts at substantially the same linear speed or where the downstream belt is driven at a slightly higher linear speed than the upstream belt. In another embodiment of the invention, a single motor driven drum is connected to frictionally engage one of the garniture belts for directly driving that belt. An idler drum having a diameter substantially equal to the motor driven drum is connected to frictionally engage the other garniture belt while an idler nip roller between the drums frictionally engages both the motor driven drum and the idler drum to thereby transmit rotational power to the idler drum so that the first and second garniture belts are driven at substantially the same linear speed or where the downstream belt is driven at a slightly higher linear speed than the upstream belt.

In still another embodiment of the invention, a first motor driven drum is connected to frictionally engage the upstream garniture belt for directly driving that belt while a second motor driven drum is connected to frictionally engage the downstream garniture belt for directly driving that belt. Other drive systems may also be used as explained in more detail below.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which:

FIG. 1 is a diagrammatic side elevational view of a filter making machine with a single long garniture belt, according to the prior art;

FIG. 2 is a diagrammatic side elevational view of a filter making machine with multiple garniture belts, according to the present invention;

FIG. 2A is a sectional view taken along line 2A—2A of FIG. 2;

FIG. 2B is a sectional view taken along line 2B—2B of FIG. 2;

DETAILED DESCRIPTION OF THE INVENTION

Figure 3:
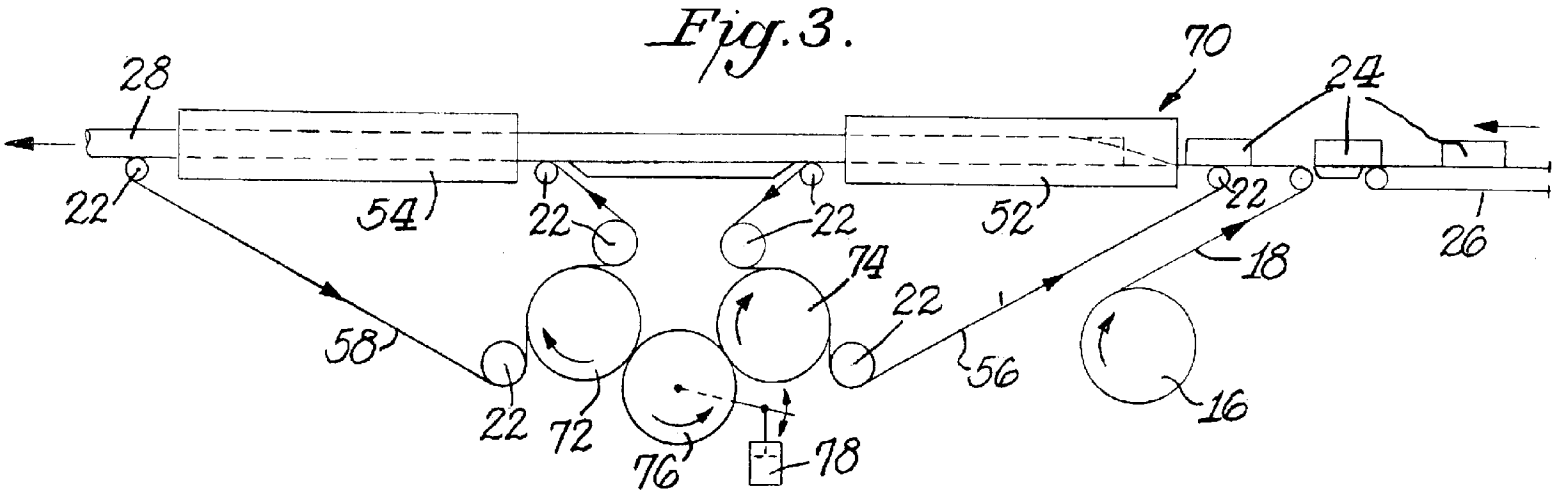
FIG. 3 is a diagrammatic side elevational view of another filter making machine with multiple garniture belts, according to the present invention.

Referring in more particularity to the drawings, FIG. 1 illustrates the prior art and specifically a filter making machine 10 including a fluted rail or garniture 12 and a single long garniture belt 14. Machine 10 includes a pre-tensioned filter paper supply roll 16 for delivering filter paper 18 through the garniture 12 during the filter making process. A motor driven drum 20 together with an array of idler rollers 22 drive and guide the garniture belt 14 along a path of travel that includes a linear portion through the garniture 12. Belt 14 pulls paper 18 axially through the garniture 12, as is well known in the art.

Spaced apart filter plugs such as cellulose acetate plugs 24 are delivered by conveyor 26 onto the filter paper 18. Other filter components (not shown) may also be delivered for placement upon the filter paper. As the paper 18 passes through the garniture 12 a series of folders, adhesive application systems, heaters and/or cooling systems, etc., form the paper around the filter components such as the cellulose acetate plugs 24 and seal the paper to produce a filter rod 28. Ultimately, the cigarette filter rod is cut at selective locations along its length to form individual cigarette filters and such filters are then attached to tobacco rods by tipping paper, as is well known in the art.

The present invention is best described against such background prior art, and FIGS. 2 through 6 illustrate several exemplary embodiments of the invention wherein similar reference characters are used to identify similar parts.

FIG. 2 illustrates a machine 50 for producing the endless filter rod 28. Machine 50 comprises a garniture that includes an upstream garniture section 52 and a downstream garniture section 54 in alignment and spaced apart from one another. Overall, garniture sections 52, 54 perform the same function as garniture 12 of FIG. 1.

Machine 50 also comprises multiple garniture belts having linear aligned portions for delivering filter paper 18 with filter components 24 thereon through the garniture sections 52, 54. In this regard, an upstream garniture belt 56 passes through upstream garniture section 52 while a downstream garniture belt 58 passes through downstream garniture section 54.

Machine 50 includes a motor driven drum 60 connected to frictionally engage both garniture belts 56, 58 for driving the belts at substantially the same linear speed. Alternatively, the downstream belt 58 may be driven at a slightly higher speed than belt 56 by allowing slight slippage between drum 60 and belt 56 through modification of the friction therebetween. This speed differential places a slight tension on paper 18 as it travels through machine 50. The drive for drum 60 may be mechanical or electrical such as a servo motor, for example. An array of idler roller 22 are arranged to define the path of travel of each garniture belt.

FIG. 2A diagrammatically illustrates a portion of upstream garniture section 52 where the filter paper 18 is formed into a U-shape while sectional FIG. 2B shows a portion of the downstream garniture 54 where the filter paper 18 is folded around the cellulose acetate plugs 24.

FIG. 3 illustrates another filter making machine 70 including upstream and downstream garniture belts 56, 58, each including linear portions that travel through the upstream and downstream garniture sections 52, 54. The belt drive system for machine 70 includes a motor driven drum 72 connected to frictionally engage garniture belt 58 for directly driving that belt. The drive for drum 72 may be mechanical or electrical such as a servo motor, for example. An idler drum 74 having a diameter substantially equal to that of motor driven drum 72 is connected to frictionally engage the upstream garniture belt 56 while an idler nip roller 76 frictionally engages both the motor driven drum 72 and the idler drum 74. This arrangement transmits rotational power to the idler drum 74 so that both garniture belts 56, 58 are driven at substantially the same linear speed. Alternatively, the upstream garniture belt 56 may be driven at a slightly lower linear speed relative to the downstream belt 58 by allowing slightly slippage between the idler nip roller 76 and drum 72 or between nip roller 76 and idler drum 74. Slippage may also be allowed between belt 56 and drum 74 to produce the lower speed of belt 56. However, accomplishing the relatively slower speed of belt 56 produces tension on paper 18 as it travels through machine 70. Frictional interaction between the idler nip roller 76 and driven drum 72 and idler drum 74 may be adjusted by increasing or decreasing the forces between these rollers with the mechanism 78 shown in FIG. 3.

Figure 4:
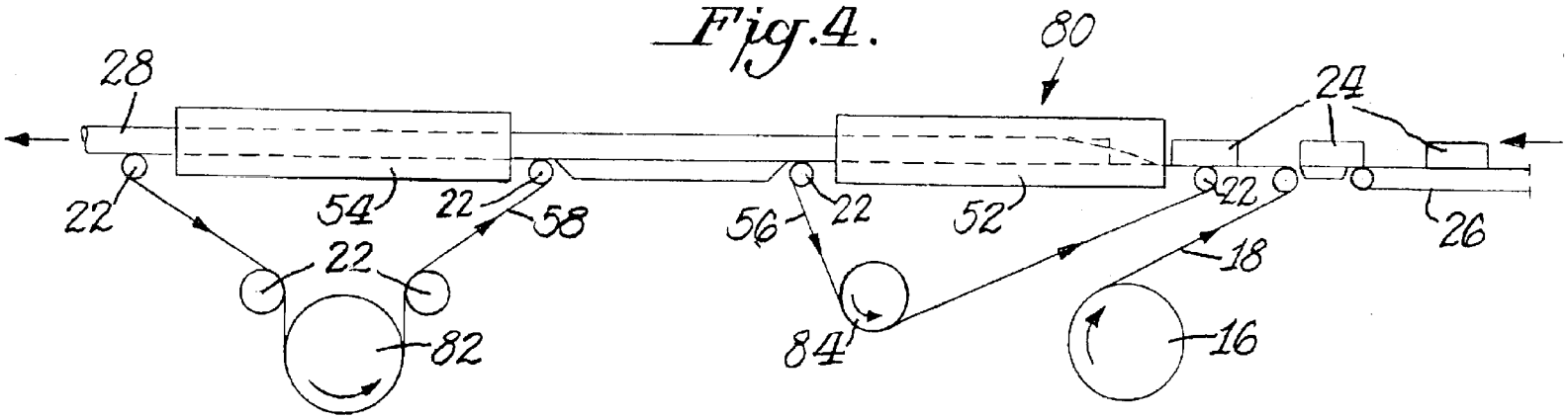
FIG. 4 is a diagrammatic side elevational view of still another filter making machine with multiple garniture belts, according to the present invention.

FIG. 4 illustrates another filter making machine 80, according to the present invention. Machine 80 uses a motor driven drum 82 to directly drive downstream garniture belt 58 and a motor driven capstan 84 functions to drive upstream garniture belt 56. The drive for drum 82 and capstan 84 may be mechanical or electrical such as a servo motor, for example. Capstan 84 has a smooth outer surface and runs at a surface speed slightly higher than driven drum 82. Tension is applied to upstream garniture belt 56 in such a way that the friction between the belt and the capstan 84 is slightly less than what is needed to overcome static friction and pull the garniture belt 56 and filter paper 18 through upstream garniture section 52. As machine 80 starts to operate, the downstream garniture belt 58 pulls the paper and assists in overcoming static friction in the upstream garniture section 52. At this point the capstan 84 provides enough friction to allow the upstream garniture belt 56 to run at a matched speed with downstream garniture belt 58.

Figure 5:
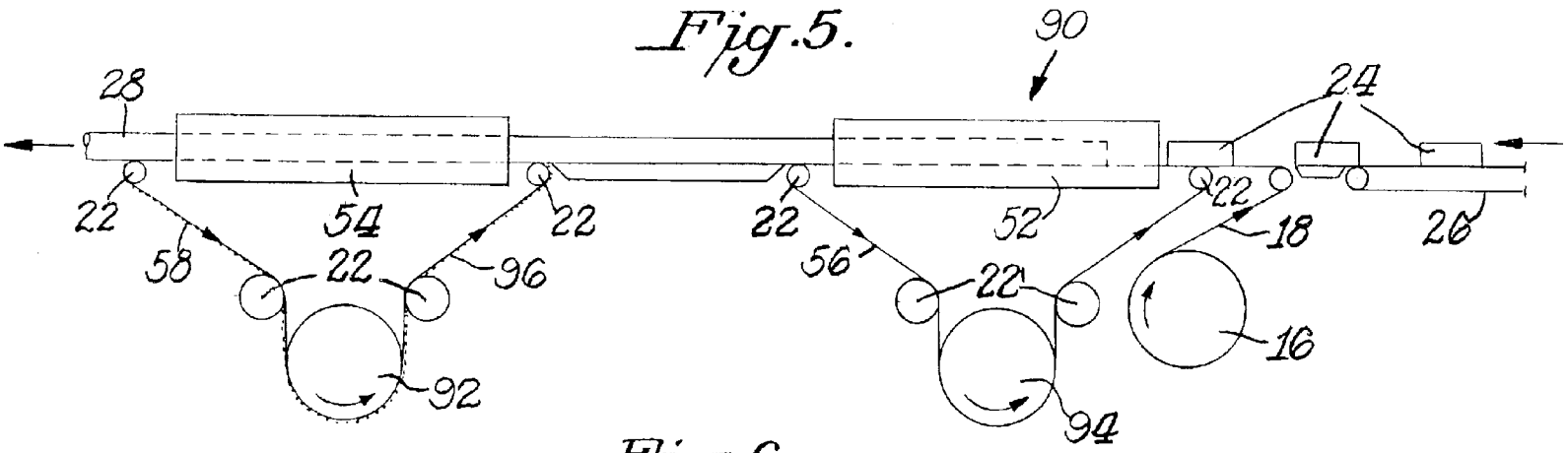
FIG. 5 is a diagrammatic side elevational view of another filter making machine with multiple garniture belts, according to the present invention.

FIG. 5 diagrammatically illustrates a filter making machine 90 that uses two separate individual motor driven drums 92, 94. The drive may be mechanical or electrical, such as with a servo motor, for example. The downstream motor driven drum 92 and the downstream garniture belt 58 pull the paper 18 and the filter rod 28 at a particular speed. The upstream motor driven drum 94 and the upstream garniture belt 56 preferably run at a slightly slower speed. Such speed differential may be produced by using a slightly smaller diameter drum on drive 94 or by running the electrical drive at a slightly slower speed. Preferably the downstream garniture belt 58 is coated with a non-slip coating 96 on the paper engaging side thereof to ensure there is no slippage of the paper. The upstream garniture belt 56 is not coated which allows paper 18 and the filter components thereon to slip slightly.

Figure 6:
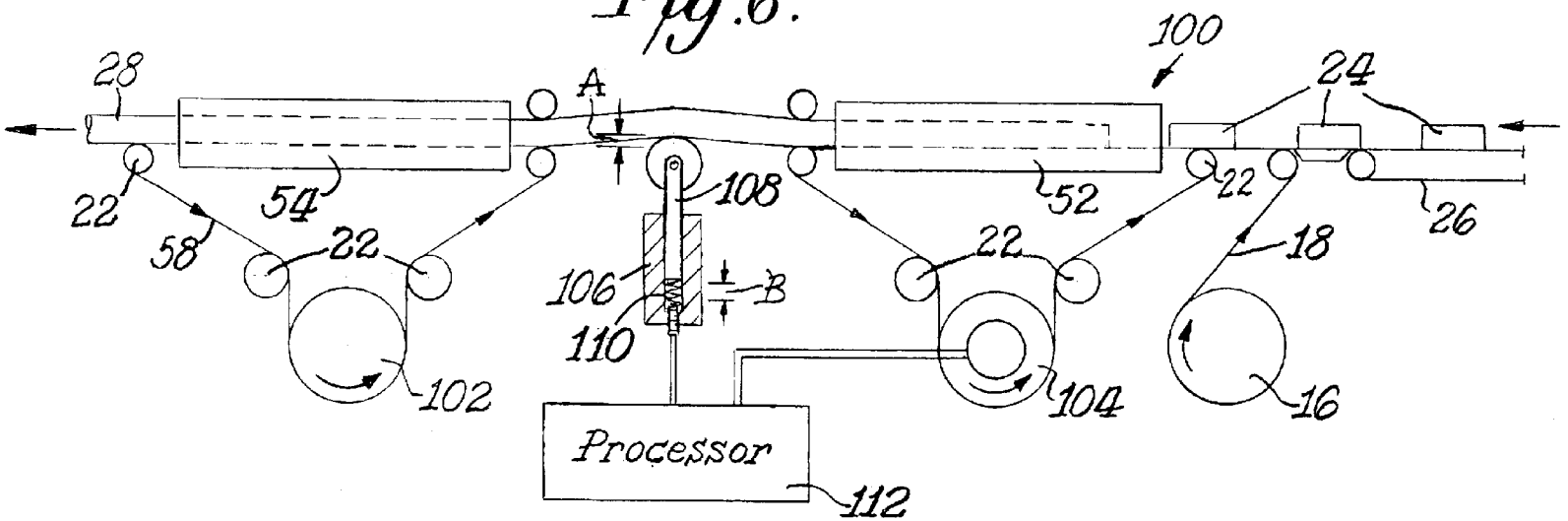
FIG. 6 is a diagrammatic side elevational view similar to FIG. 5, but additionally illustrating an arrangement for sensing tension variations of the continuous filter rod and then making incremental speed adjustments in response thereto to the phase relationship between the upstream and downstream garniture belts, according to the present invention.

FIG. 6 diagrammatically illustrates still another machine 100 for producing filter rods 28. Two independent motor driven drums 102, 104 are utilized to drive the upstream and downstream garniture belts 56, 58. The particular drive may be mechanically or electrically such as a servo motor, for example. Differences in speeds between the upstream and downstream garniture belts 56, 58 produce a particular tension in the filter rod 28 between the upstream and downstream garniture sections 52, 54, and a sensor 106 is positioned between the garniture sections to determine the relative tension on the filter rod in that area. Sensor 106 consists of a vertically traveling member 108 loaded against the filter rod 28 by a coil spring 110. The force of the coil spring slightly deflects the filter rod 28 a distance that is related to the tension in the rod. Such deflection represented at A is measured at B and a signal is transmitted to a processor 112 which determines the tension in filter rod 28. If the tension varies from a predetermined value, processor 112 signals drive 104 to make incremental adjustments to the phase relationship between drive 104 and the drive 102 for the downstream garniture belt 58. If necessary the electronic gearing ratio of drum drive 104 may be altered.

What is claimed is:

1. A machine for producing an endless filter rod comprising garniture means, and multiple garniture belts having linear aligned portions for delivering filter components thereon through the garniture means along a linear path, the garniture means including an upstream garniture belt passing through the upstream garniture section and a downstream garniture belt passing through the downstream garniture section, the machine further including a motor driven drum connected to frictionally engage both the upstream and downstream garniture belts for driving the belts at substantially the same linear speed.

2. A machine for producing an endless filter rod comprising garniture means, and multiple garniture belts having linear aligned portions for delivering filter components thereon through the garniture means along a linear path, the garniture means including an upstream garniture belt passing through the upstream garniture section and a downstream garniture belt passing through the downstream garniture section, the machine further including a motor driven drum connected to frictionally engage one of the garniture belts for directly driving that belt, an idler drum connected to frictionally engage the other garniture belt, and an idler nip roller frictionally engaging both the motor driven drum and idler drum for driving the idler drum.

3. A machine for producing an endless filter rod comprising garniture means, and multiple garniture belts having linear aligned portions for delivering filter components thereon through the garniture means along a linear path, the garniture means including an upstream garniture belt passing through the upstream garniture section and a downstream garniture belt passing through the downstream garniture section, the machine further including a first motor driven drum connected to frictionally engage the upstream garniture belt for driving that belt, and a second motor driven drum connected to frictionally engage the downstream garniture belt for driving that belt.

4. A machine for producing an endless filter rod as in claim 3 wherein the first motor driven drum drives the upstream garniture belt at a slightly lower linear speed than the second motor driven drum drives the downstream garniture belt.

5. A machine for producing an endless filter rod as in claim 4 wherein both the first and second motor driven drums rotate at substantially the same speed, and wherein the first motor driven drum has a slightly smaller diameter whereby the upstream garniture belt is driven at a slightly lower linear speed.

6. A machine for producing an endless filter rod as in claim 5 wherein the downstream garniture belt has a non-slip coating on a side thereof engaging the filter paper to ensure no slippage of the paper, and wherein the upstream garniture belt allows slight slippage between the belt and the paper thereon.

7. A machine for producing an endless filter rod comprising garniture means, and multiple garniture belts having linear aligned portions for delivering filter components thereon through the garniture means along a linear path, the garniture means including an upstream garniture belt passing through the upstream garniture section and a downstream garniture belt passing through the downstream garniture section, the machine further including a fist motor driven drum connected to drive the upstream garniture belt and a separate motor driven drum connected to drive the downstream garniture belt, a sensor positioned between the first and second garniture sections connected to determine the tension of the filter paper and the filter components thereon in the area between the first and second aligned garniture belts, and a control connected to make incremental adjustments to at least one of the motor driven drums in response to tension determined by the sensor to thereby maintain a predetermined tension on the paper and filter components in the area between the garniture belts.

8. A machine for producing an endless filter rod as in claim 1, 2, 3, or 7 including paper supply means immediately upstream from the garniture means for delivering endless filter paper to the garniture means.

* * * * *